US006039276A

United States Patent [19]

Hatt et al.

[11] Patent Number: 6,039,276

[45] Date of Patent: Mar. 21, 2000

[54] APPARATUS AND METHOD FOR CRUSHING SUGAR CANE

[75] Inventors: Raymond John Hatt; David John Wilson, both of Bundaberg; Druce Barry Batstone, Taringa, all of Australia

[73] Assignee: Bundaberg Foundry Engineers Ltd., Queensland, Australia

[21] Appl. No.: 09/191,145

[22] Filed: Nov. 13, 1998

Related U.S. Application Data

[63] Continuation of application No. PCT/AU97/00291, May 9, 1997.

[30] Foreign Application Priority Data

May 20, 1996 [AU] Australia ..... PN9930
Nov. 1, 1996 [AU] Australia ..... PN3356

[51] Int. Cl.[7] ..... B02C 19/12

[52] U.S. Cl. ..... 241/30; 241/159; 241/236; 241/293

[58] Field of Search ..... 100/174, 176; 241/85, 88.1, 93, 293, 159, 236, 30

[56] References Cited

U.S. PATENT DOCUMENTS

| | | |
|---|---|---|
| 1,700,571 | 1/1929 | Milne . |
| 1,834,852 | 12/1931 | Kutter . |
| 2,151,405 | 3/1939 | Hurter et al. . |
| 3,969,802 | 7/1976 | Bouvet . |
| 4,420,863 | 12/1983 | Trimmer et al. . |

FOREIGN PATENT DOCUMENTS

| | | |
|---|---|---|
| 74 784/81 | 3/1983 | Australia . |
| 84 046/82 | 11/1983 | Australia . |
| 34686/84 | 5/1985 | Australia . |
| 10914/88 | 8/1988 | Australia . |
| 0 108 687 | 5/1984 | European Pat. Off. . |
| 520097 | 6/1921 | France . |
| 2 251 622 | 6/1975 | France . |
| 2 569 608 | 3/1986 | France . |
| 26 57 232 | 6/1978 | Germany . |
| 27 16 666 | 10/1978 | Germany . |
| 3427418 | 1/1986 | Germany . |
| 162124 | 4/1921 | United Kingdom . |
| 2 025 260 | 1/1980 | United Kingdom . |

*Primary Examiner*—Mark Rosenbaum
*Attorney, Agent, or Firm*—Akin, Gump, Strauss, Hauer & Feld, L.L.P.

[57] ABSTRACT

An apparatus for crushing sugar cane to extract the juice has opposed crushing rolls at least one of which is formed with juice channels which are temporarily plugged by bagasse after the juice has entered into the channel. Further rotation of the rolls removes the trapped juice away from the cane blanket and the bagasse plug is then scraped out of the top of the channel to allow the juice to drain. The juice is drained away from the cane blanket and is not reabsorbed thereby. Efficiency of juice removal is improved. Further efficiency improvements are obtained by having pairs of crushing rolls positioned above each other such that the cane blanket moves in a generally vertical direction.

8 Claims, 5 Drawing Sheets

APPARATUS AND METHOD FOR CRUSHING SUGAR CANE

CROSS-REFERENCE TO RELATED APPLICATION

This application is a continuation of International Application PCT/AU97/00291, filed May 9, 1997 (WO 97/44494), the disclosure of which is incorporated herein by reference.

BACKGROUND OF THE INVENTION

This invention relates to an apparatus and method for crushing sugar cane to improve the drainage and separation of the sugar juice from the cane or bagasse.

Sugar juice is removed from sugar cane by crushing the cane between crushing rollers. The cane is initially chopped into short lengths of about 20–50cm (called billets), or is shredded into a finely divided form. The billet or shredded cane is then crushed in a number of spaced apart mills.

A known type of mill is a three roll mill which consists of two bottom rolls next to each other and a top roll, the arrangement being that the centres of the roll shafts form a triangle. In this arrangement, a blanket of sugar cane or bagasse passes through the rolls in a generally horizontal or slightly inclined manner and juice is extracted during the crushing process.

Another known mill employs a pair of counter rotating rollers one above each other such that the sugar cane moves horizontally between the rolls.

Sometimes, the mill has one or more additional rolls in front of the main crushing or primary rolls. The additional rolls are there to push a blanket of compressed sugar cane or bagasse to the main crushing rolls. In doing this, the additional rolls usually crush some juice from the cane or bagasse, but this is incidental and the primary function of these rolls is to force the cane or bagasse to the crushing rolls.

When sugar cane is crushed in a factory, the cane passes through a number of separate mills. Each mill consists of the above mentioned two, three, four or more roller arrangement. The sugar cane is conveyed from one mill to the next mill for further crushing.

A common feature of all current conventional mills is that the lower roll functions to drain most of the sugar juice from the crush. This is primarily because of gravity effects causing the extracted sugar juice to move under the influence of gravity to the bottom roll. However, the top roll is also a crushing roll and extracted sugar juice also accumulates on top of the horizontally moving blanket of cane of bagasse.

To remove this juice, openings are sometimes present in the top roll through which the sugar juice can pass and drain from each end face of the roll. Such rolls are known as "lotus" rolls.

To improve the crushing efficiency of the cane or bagasse, it is known to groove both the top roll and the bottom roll to form a meshing-type effect.

For the bottom roll, it is known to cut additional juice grooves to a depth of about 25 mm in each or every second or third groove in the roll to facilitate juice drainage. The juice grooves provide a path for the juice to flow away from the crush.

However, a disadvantage with this is that the juice flows backwards against the direction of the roll. This counterflow of sugar juice against the roll surface movement is deleterious to the efficiency of juice removal. The frictional resistance of the roll surface in contact with the juice retards the flow of juice. The retardation effect increases as roll surface speed increases. Therefore the possible benefits of juice grooves are limited by flow retardation and may be cancelled out altogether as surface speed increases to the point that counter flow of juice ceases and the juice is carried forward with the roll.

This effect also severely limits the capacity of the mill, as capacity is directly related to the roll length, roll diameter and roll speed.

Increasing roll speed in conventional mills to above about 300 mm per second can result in a sharp decline in extraction efficiency.

Attempts have been made to place deep penetrating scrapers into the grooves in front of the roll in order to remove bagasse, but this has the unfortunate consequence of forcing the juice to be reabsorbed by the bagasse which again results in a decline in extraction efficiency.

When sugar cane is conveyed from one mill to the next mill, the cane blanket tends to expand as it is discharged from one mill and before it gets compressed and crushed by the next mill.

In order to improve the efficiency of the sugar juice extraction in the next mill, it is known to add water, or dilute juice to the sugar cane blanket as it expands, this process being known as "inhibition".

A disadvantage with adding water, or dilute juice at this stage in a two roll mill is that the sugar cane blanket is also required to be in a semi-compressed form. Pressure chutes are therefore positioned between each crushing stage. The pressure chutes maintain the sugar cane blanket or bagasse in a semi-compressed form as a consequence of the driving force necessary to transfer the bagasse to the next stage where the bagasse is transferred horizontally.

However, by maintaining the bagasse in a semi-compressed form, it does not fully expand and therefore inhibition is not totally successful.

When inhibition liquid is added to the semi-compressed bagasse, not only does the bagasse not absorb as much liquid as is possible if the bagasse was not maintained in a semi-compressed system, but because the bagasse is conveyed along a horizontal or slightly inclined angle, the inhibition liquid is sprayed or added to the top of the bagasse blanket and does not easily permeate through the blanket. It is generally not possible to spray or apply liquid to the bottom of the bagasse blanket as gravity effects will cause the spray or liquid to simply fall away and not be absorbed.

Another disadvantage with existing mills is the deleterious effect of upflow of sugar juice against the downflow movement of the sugar cane. For example, in the conventional three roll mills or the two roll mills where one roll is above the other roll, the sugar cane or bagasse moves along a generally horizontal pathway (although the pathway may be slightly inclined in particular areas). With the large pressures being exerted on the sugar cane between the crushing rolls, it is found the sugar juice has a tendency to move upward on to the face of the rolls and is therefore not efficiently separated from the cane. The upflow of juice also reduces the grip of the rolls on the bagasse by making the rolls slippery. The effect is a result of the substantially horizontal movement of the sugar cane or bagasse through the mill. Another disadvantage with the current mill arrangement is that if any pair of rolls has a mechanical fault, the entire tandem must stop operating as the defective stage cannot be bypassed.

Another disadvantage with existing mill arrangements is that the supply end of a pair of rolls has a fairly small feed zone which is the cross-section area where the bagasse begins to be pulled in by the rolls. It is desirable to have the feed zone as large as possible over which sugar cane or bagasse will self-feed into the rolls. Feed rolls are known to increase the cross-sectional area of the feed zone but add significantly to the cost of the equipment.

Another disadvantage with conventional mills is their high power consumption due to the large number of rolls required to provide an acceptable level of juice extraction.

Much attention has also been given to the design and manufacture of the crusher roll used in crushing sugar cane.

Crusher rolls are extremely well-known in the sugar cane industry and are widely used in sugar cane crushing mills to extract sugar cane juice from sugar cane, prior to clarification, evaporation and crystallisation of the sugar from the juice.

Much research and development has been undertaken to improve the efficiency of sugar juice extraction from the cane. The efficiency is measured in the power consumption required to drive the crusher rolls, the throughput of the sugar cane, and the extraction efficiency of the sugar juice from the cane.

It is known that the extraction efficiency can be improved by grooving the periphery of the crusher rolls, and by providing juice discharge channels behind the periphery. Examples of such rolls are found in the patent literature and the following patent documents exemplify the current rollers—Australian Patent Applications 74784/81, 84046/82, 34686/84, 10914/88; U.S. Pat. Nos. 3,536,002, 4,077,316, 4,220,288, 4,378,253, 4,168,660, 4,420,863, 4,804,418; United Kingdom Patent Application 2,025,260; French Patents 2,251,622, 2,569,608; German Patents 2,716,666, 2,657,232, 3,427,418.

The juice channels extend longitudinally inside the roll and just behind the peripheral or crushing surface of the roll. The juice channels are normally relatively small diameter tubes formed in the roll. These tubes are in fluid communication with the surface of the roll as is known in the art, and the function of the juice channels are to improve the separation of the liquid from the material to be crushed. The juice channels do not join each other and a fairly large number of parallel extending separating juice channels extend entirely around the roll.

The juice channels in turn communicate with an outlet such that juice can flow through the channel and into the outlet where in turn it is carried away for further processing. The outlet can be associated with a valve if desired. Outlets can be provided on both side faces of the roller, or on only one side face. The outlets are in sliding but sealing engagement with the side face of the roller such that as the roller rotates, the separate juice channels pass along the outlet to drain the juice. It is possible for the outlet to extend entirely around the roller, but it is more common for the outlet to extend only along a portion of the side face of the roller, this portion of course being where the juice passes into the juice channels.

It is known that crushing efficiency is improved by increasing the diameter of the rolls. However, the design and geometry of conventional 3, 4, 5 and 6 roll mills constrains the diameter of the rolls to about one half the length of the roll. This diameter to length ratio has been found to offer a reasonable compromise between capacity, extraction efficiency and roll weight.

The conventional thinking and teaching to improve the efficiency of the roller is by changing the peripheral groove shape, providing drainage channels in the roller, providing back pressure to the roller, and reducing the gap between the rollers.

SUMMARY OF THE INVENTION

The present invention is directed to an apparatus and method for crushing sugar cane to extract the juice therefrom, and which may overcome the abovementioned disadvantages or provide the public with a useful or commercial choice.

In one form the invention resides in an apparatus for extracting juice from sugar cane, the apparatus having a pair of counter rotating rolls between which the cane is crushed, at least one of the rolls having a peripheral juice channel extending about the roll and into which sugar juice can flow, the channel being configured such that a sealing plug of bagasse can form in an upper portion of the channel with a lower portion of the channel left free for holding the juice, bagasse plug removing means to remove the plug of bagasse to allow the juice to drain from the channel at a position where the juice does not contact the crushed cane blanket.

In another form, the invention resides in a method for extracting juice from sugar cane comprising crushing the cane between a pair of spaced apart counter rotating rollers, the cane moving in a generally vertical direction as it passes between the rollers and is crushed, passing extracted juice into a juice channel on at least one of the rollers, sealing the channel opening with a layer of compacted bagasse in the crushing zone of the rollers, rotating the roller to move the sealed channel away from the crushing zone and into a juice collecting zone and removing the bagasse to drain the channel.

It is found that the apparatus and method provides a satisfactory level of juice extraction with less power consumption and with a much simpler design.

The counter rotating rolls can be of various diameters and lengths, and the rolls can be made from various materials, a typical material being cast iron.

The rolls are typically in a side by side relationship with the axis of rotation being horizontal such that the sugar cane or bagasse passes between the rolls in a substantially vertical direction.

The rolls are typically spaced apart such that the roll surfaces can crush sugar cane or bagasse as the rolls counter rotate. One or both of the rolls may be grooved to facilitate crushing.

At least one, and preferably both of the rolls, have juice channels to collect the juice as the sugar cane or bagasse is crushed between the rolls.

It is preferred that the juice channel extends right around the roll to facilitate entry of juice into the juice channel and discharge of juice from the channel.

The juice channel may be of various crosssection shapes one type of juice channel may be "bottle-shaped" having a narrower necked portion in the base of the groove in the roll opening up into a larger channel portion. The necked portion may facilitate in restricting or preventing cane or bagasse from passing into the juice channel.

In another form, the juice channel may be substantially U-shaped with parallel side walls, the channel having a depth larger than the grooves in a conventional roll. It appears that sugar cane or bagasse passes over the top or only partially into the channel but does not entirely fill the channel.

In another form, at least one of the rolls may be grooved in a conventional manner with apertures being formed in the bottom of the groove the apertures communicating with an internal juice channel to convey juice away from the crush zone between the rolls.

In another form, the invention includes a mill roll which can have a significantly larger diameter than previously possible without compromising the overall weight of the roll. This allows the roll to be removed by a crane while being well within the maximum safe working load. By having a larger diameter roll, the feed zone is increased, the feed zone being the area above the inlet where the cane is grabbed by the rolls and forced between the rolls.

Larger diameter rolls can therefore be made shorter in length without decreasing capacity. The larger feed zone area associated with larger diameter rolls can also lead to higher extraction as higher levels of fibre density can be obtained in the crushing zone of the rolls.

The mill roll can include a central hub portion of a first length, an annular web portion extending outwardly from the hub portion and having a thickness which is considerably less than the first length, and a peripheral rim portion adapted for grinding contact with the material.

By having the mill roll in the above configuration, the roll has a much smaller volume of material compared to the conventional solid rolls and is thus cheaper to fabricate.

The weight of the roll is also much reduced thereby allowing the roll to have a larger diameter than hitherto possible and/or a much longer length while still being within the weight limit required by the working load of the crane. This in turn can bring a substantial increase in the crushing capacity and juice extraction.

The hub of the roll can have a central bore therethrough to allow the roll to be mounted to a shaft. The shaft may be more or less of conventional design and may comprise a steel shaft which is conventionally used to mount known mill rolls.

The roll itself may be formed from any convenient material. Mill rolls are typically manufactured from a special grade of cast iron which has been found to be effective in sugar cane crushing and thus the roll may be formed from a similar material it is possible for the roll to be made from steel, other metals, or alloy blends. The peripheral surf ace of the roll may be grooved and the grooves may be similar to the grooves which are already known and used in sugar crushing. The grooves may be hard faced or protected by any of the well-known methods for coating or deposition with wear-resistant materials.

The outer surface of the roll may be perforated and the perforations may allow extracted sugar juice to pass through the perforations and into juice drainage channels located within the roll.

The hub has a first length, and this length may be sufficient to allow the hub to be firmly attached to the shaft. The length of the hub may of course vary and is more or less determined by the desired length of the mill roll itself, and/or the diameter of the mill roll.

The peripheral rim portion has an outer surface which is in grinding contact with the sugar cane. The rim portion may have internal channels to carry away extracted sugar juice. The rim portion has a length, and as with the hub portion, the length can vary to suit the desired length of the mill roll and/or the diameter of the mill roll. It is however preferred that the length of the rim portion is about the same as the length of the hub portion.

The annular web portion extends between the rim portion and the hub portion and functions to connect the two together. It is preferred that the web portion is approximately mid-way along the hub portion and the rim portion such that the roll is symmetrical.

To allow weight reduction in the mill roll, the web portion has a thickness which is considerably less than the length of the hub portion, and it is preferred that the web portion has a thickness which is at least half or even less than half the length of the hub portion.

It is also preferred that the thickness of the hub portion approximates the thickness of the web portion and that the rim portion is also approximately the same thickness or perhaps marginally thinner than the thickness of the hub portion.

Another form of the present invention has been developed from the surprising discovery that many of the disadvantages of known mills can be overcome or at least reduced by providing a system of mills having a pair of opposed rolls and where the mills are arranged above each other such that the sugar cane or bagasse moves along a generally vertical pathway as it moves from one set of rolls to the next set of rolls.

Therefore, in another form, the invention resides in a mill for extracting liquid from a liquidcontaining material such as sugar cane, the mill comprising a plurality of pairs of opposed crushing rolls between which the material can pass, the pairs of opposed rolls being spaced above each other and having a generally vertical discharge end such that the material follows a generally vertical pathway from the discharge end of one pair of rolls to the supply end of a lower pair of rolls.

Preferably, the rolls are arranged such that the supply end is substantially vertical as is the discharge end.

It is found that by having a vertical supply end, the cross-section area over which sugar cane or bagasse will self-feed is increased. Higher compression and improved juice extraction can be achieved from a single pair of rolls due to the increased quantity of sugar cane or bagasse that can be drawn in from the larger than hitherto possible cross-section area which can be referred to as the "feed zone".

It is preferred that the crushing rolls are arranged with their axis of rotation on a horizontal or near horizontal plane. If desired, the or each pair of opposed rolls can be associated with feeder rolls, tall chutes, apron feeders or other devices which can increase the density of the bagasse in the feed zone, these devices being known.

By having a vertical discharge from the rolls on a horizontal or near horizontal plane, the supply of bagasse from one set of rolls to the next set of rolls is greatly simplified. Typically, four, five or six stages of crushing can be employed with a counter current addition of juice to bagasse in the process known as "inhibition".

It is preferred that the vertical discharge end of a said pair of opposed rolls extends vertically above the supply end of a lower pair of rolls.

This can be achieved by having the pair of rolls substantially vertically above each other to form a tower-type arrangement.

In this arrangement, conveyors, elevators or pressure feed chutes are no longer required. The vertical arrangement can therefore be much simpler mechanically compared to a conventional system where the rolls are arranged horizontally with intermediate carriers or elevators between each stage.

By having the vertical arrangement or roll pairs, and by not requiring pressure chutes between each stage, the bagasse can expand more than hitherto possible and therefore the inhibition process is much more effective.

Another advantage with the vertical arrangement is that the inhibition fluid can be added to both sides of the bagasse blanket and will be absorbed by both sides. This is in contrast to the pressure chute arrangement where the bagasse can only be sprayed more or less on the top side of the bagasse blanket.

Another advantage with the vertical arrangement is that if any pair of rolls has a mechanical fault, it can be simply pulled out of service and the bagasse blanket can then naturally pass under gravity to the roll set below the defective roll set. This means that the mill can still operate (albeit with one less set of rolls).

As mentioned above, by having a gravity assisted system, the bagasse exiting from a discharge end of one set of rolls can be decompressed fully to improve mixing of the inhibition liquids. Further steps can be taken such as the use of mechanical agitators and liquid jets to further enhance the reduction of compressed lumps of bagasse into the constituent smaller particles.

Another advantage of the "tower" mill design as described above is the small ground area required, relative to the conventional mills.

In an embodiment, a pair of side by side horizontal rolls are provided with radial and axial holes in each roll. During crushing, juice flows through the holes and is satisfactorily separated from the bagasse. A significant proportion of the juice is observed to flow out the holes as they reach the base of the roll.

In another embodiment, the rolls were changed to provide a full circumference narrow slot in the base of each circumferential groove. The slot opened up to a larger width dimension of approximately 12 mm and was carried radially inwards to the inner edge of the axial holes. The full circumference slot provided a much larger cross-sectional area for the inward flow of juice in the compression zone (crush zone) compared to the separate radial slots, and a much larger cross-sectional area for the drainage of juice down to the bottom of the roll.

The narrow entry was provided to restrict the entry of bagasse, the diverging section was provided to facilitate removal of any bagasse particles which did enter. Reverse drainage of juice into the bagasse into the expansion zone subsequent to the nip of rolls would be inhibited by the narrow part of the slot.

The above rolls, with the full circumference juice channels, provided a very significant improvement in performance. There was very little upward flowing of juice and most of the juice passed downwardly to the bottom of the rolls.

In a further embodiment, a roll was manufactured using conventional cast iron material and was grooved with conventional tooling. This reduced the manufacturing cost compared to the method used to provide rolls with an inwardly diverging full circumference juice channel.

In the conventional cast iron roll, a juice channel was formed as a parallel slot approximately 5 mm wide and 50 mm deep. While juice channels are known in conventional bottom feed rollers, conventional juice channels do not have the depth to diameter ratio given above, the ratio being selected to provide for the drainage of the juice from the channel.

It was thought that by providing an open slot juice channel, there would be significant re-absorption of juice from the channel into the bagasse into the expansion zone occurring after the crushing zone.

However, surprisingly and unexpectedly, very little or no decrease in performance was observed. That is, the juice was found not to re-absorb significantly in the bagasse notwithstanding that the channel was an open slot. It was found that juice collected from the large width parallel channel roll was about the same as juice collected in the above described narrow entry channel roll.

While not wishing to be bound by theory, it appears that the juice channel is sealed by the bagasse being forced into the upper part of the channel. This is supported by noticing that in the expansion zone, the blanket of bagasse splits into two parts, each part attached to the grooved surface of the roll. The bagasse was highly compacted and permeability measurements show the bagasse in this highly compacted state to be largely impermeable, and therefore unable to re-absorb juice from the channel. The juice in the channel is therefore restrained in the full circumference juice channel by the "plug" of impermeable bagasse until well past the scraper.

A particularly beneficial feature of the invention is the enhancement to the discharge flow of juice by having juice flowing in the same direction as the blanket of sugar cane or bagasse.

With conventional rolls, an increase in roll speed provides a sharp decline in extraction efficiency. No such limitation is imposed by the apparatus of the invention where, the rolls can be placed in a substantially horizontal arrangement which results in drainage by equal sharing of juice drainage by the two rolls and juice flow in channels in the same direction as the roll movement.

Table 1 shows juice extraction as a percentage of roll speed for a conventional mill and for the rolls according to an embodiment of the invention.

TABLE 1

| SPEED MM/S | JUICE EXTRACTION % |
|---|---|
| CONVENTIONAL ROLL (HORIZONTAL FEEDING) | |
| 142 | 66.5 |
| 181 | 62.6 |
| 210 | 62.5 |
| 291.5 | 60.0 |
| 311 | 60.8 |
| INVENTION ROLL (VERTICAL FEEDING) | |
| 153 | 74.2 |
| 203 | 73.3 |
| 303 | 72.7 |

In the above table, both mills were crushing finely prepared sugar cane. The compression ratio for the conventional mill was 3.5 and the compression ratio for the mill according to the invention was 3.1. The higher the compression ratio, the better the juice extraction is. The results demonstrate the clear benefits of improved juice drainage in the present invention. Not only is the juice extraction appreciably higher at the lower compression ratio but the deleterious influence of higher speed is much less marked.

The ability to operate at higher speeds is an important attribute of the present invention as capacity is directly related to roll speed. Capacity is also directly related to roll length and diameter. In the present invention, it is found that two rolls of near standard geometry have about the same capacity as a conventional five or six roll mill if the two rolls operate at about twice the speed of conventional rolls. The reduction to two rolls achieves a substantial saving in manufacturing and installation cost.

A further beneficial feature of the invention is the equal sharing of juice drainage by the two rolls which is contrary to conventional crushers where most juice is discharged from the lower roll only.

A further comparison was made between the mill which is the subject of the current application, and known commercial equipment, with the results given in table 2. Prepared cane was collected from a sugar factory and at the same time, bagasse discharging from the first mill of the factory was sampled. This mill is a conventional six roll crusher. The prepared cane and bagasse from both the commercial mill and the mill the subject of the current application was analysed and pol extraction compared over the same compression ratio range. Pol extraction on any first mill is slightly higher than juice extraction (the basis for the previous comparison between two experimental units). Pol is a measure of sucrose.

TABLE 2

| COMPRESSION RATIO | POL EXTRACTION % |
|---|---|
| CONVENTIONAL MILL (HORIZONTAL FEEDING) | |
| 3.6 | 69.0 |
| 3.7 | 65.1 |
| 3.9 | 72.0 |
| 4 | 70.8 |
| 4.1 | 74.4 |
| INVENTION MILL (VERTICAL FEEDING) | |
| 3.2 | 75.4 |
| 3.4 | 72.3 |
| 3.5 | 78.7 |
| 3.7 | 79.1 |
| 3.8 | 80.0 |
| 4.4 | 81.3 |

The invention mill consisting of one pair of horizontally opposed rolls shows a clear advantage in extraction performance in the same compression range. Juice drainage from the base of the rolls in the present invention avoids problems with juice entry into bearings which rotatably support the rolls, this being a common problem with conventional mills. Mill hygiene is also improved.

Power consumption by the invention mill is also substantially less than the power consumed per tonne of cane crushed by conventional six, five, four and three roll mills. The five and six roll mills have two pressure feeder plates and a turn bar which absorb energy through frictional resistance. The pressure feeder plates and turn bar have scrapers to clear compacted bagasse from the angled grooves in the roll surface. In fact, all rolls must have scrapers so for each additional roll there is additional energy consumption from the extra scraper.

Clearing of bagasse from the uniquely deep juice channels in the present invention has led to the development of novel scrapers and support arrangements.

The use of two stages of bagasse scraping is preferred. In the first stage, the scrapers form the leading edge of the discharge chute. Conventional scrapers are manufactured from steel plate and have teeth cut to match the angled groove in the roll. Where bagasse is packed down to the base of the groove, the scraper teeth suffer excessive wear. In the present invention, bagasse and juice are moving in the same direction—the bagasse in the angled portion of the groove and juice in the inner parallel channel. Clearly the scraper should not penetrate too far into the parallel section but some penetration by the leading tooth point is desirable to lift the bagasse from underneath where the bagasse is loosely compacted bagasse without the wear imposed by cutting through heavily compacted bagasse. An improved scraper has been developed which has a blade of spring steel or other suitable material in each parallel groove. The blades are supported on a scraper plate which has suitably shaped teeth. However the function of the plate is to move the bagasse loosened by the blade into the discharge chute. The blade therefore projects well in front of the plate section. The tip may be located close to the nip of the roll. The blade can be a replaceable element held in a slot in the plate or by other suitable means.

The second scraper is similar to scrapers used to clean the shallow juice grooves. However by locating the scrapers so that they hang down vertically and by the use of a suitably shaped blade, the scrapers may be mounted on a round or shaped bar so that they are free to move laterally and have some freedom of movement in and out of the groove. Scraper blades mounted in this manner are held in the groove by the movement of the roll and the small force of the discharging bagasse.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings.

DETAILED DESCRIPTION OF THE INVENTION

Figure 1:
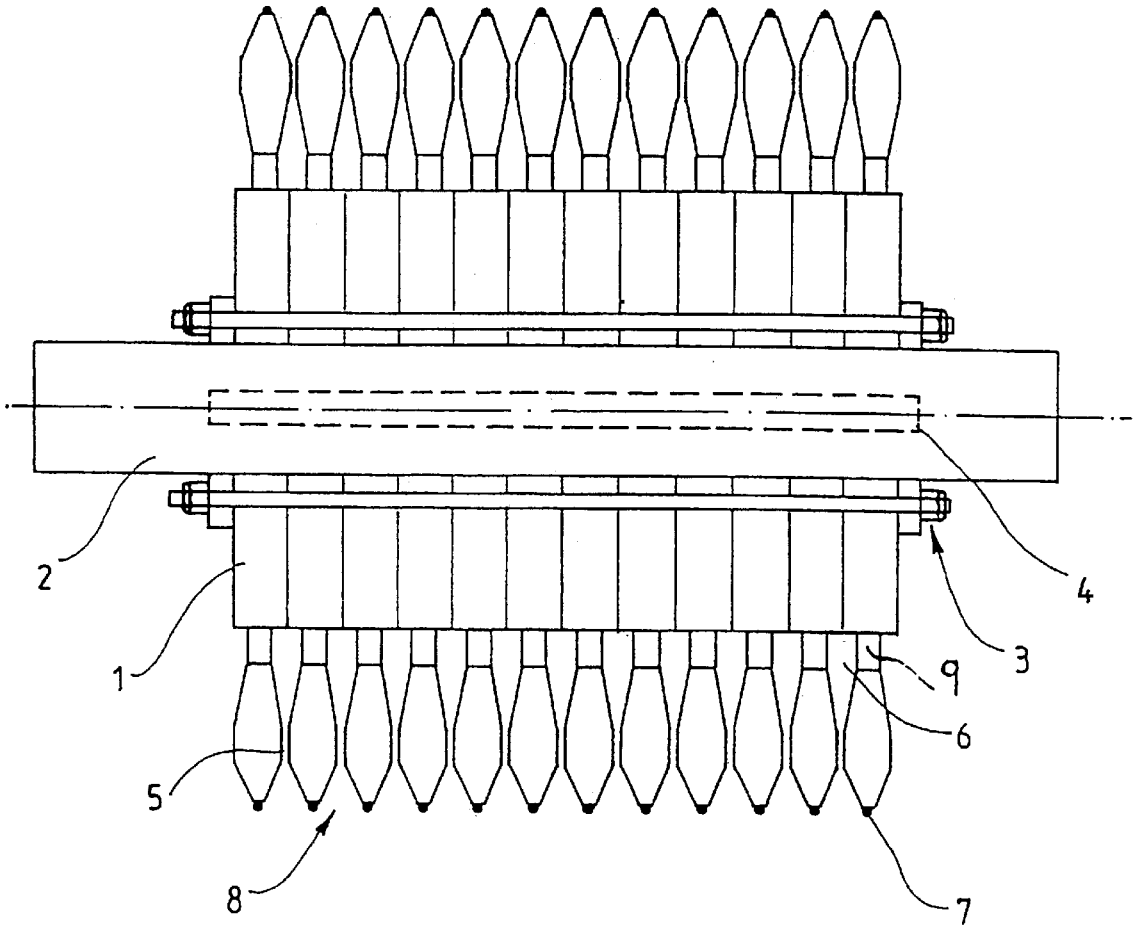
FIG. 1 is a longitudinal cross-section of a mill roll according to a first embodiment.

Referring to the figures and initially to FIG. 1, there is shown a longitudinal cross-section of a single roll.

Roll consists of parallel circular plates 1 mounted on a central shaft 2 by any conventional means. The plates are shaped to form an angled full circumference groove 8 which converges to a narrow full circumference slot 5 radially in and then diverges to a wider full circumference channel 6. The channel 6 intersects axial holes 9. A hard, rough coating 7 may be deposited on the tip and flank of the angled grooves. In operation, the juice-laden cane or bagasse is forced into the grooves by the opposing horizontal roll. Tightly compacted bagasse is restricted to the angled groove portion 8. Juice is free to flow radially in and down through the full circumference channel and out through the radial holes. In practice the path of least resistance is down and virtually no juice flows through the axial holes.

Figure 2:
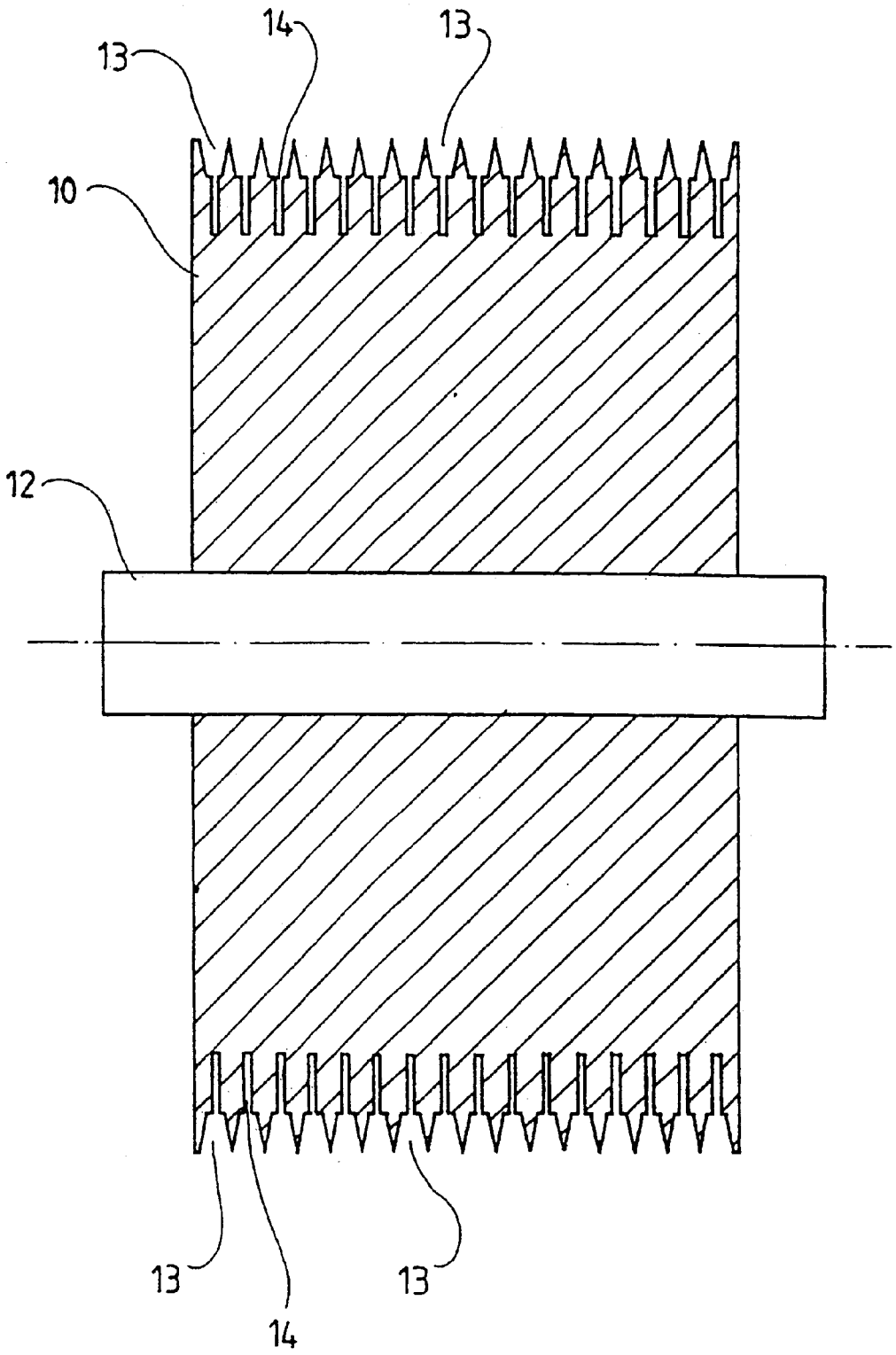
FIG. 2 is a longitudinal cross-section of a mill roll according to a second embodiment.

FIG. 2 illustrates the longitudinal crossection of a second form of a crusher roll that is less costly to manufacture, is easier to clean, and offers improved juice drainage. The roll may be made of one or more pieces 10 of solid cast iron, SG iron, steel or other suitable material in the form of a shell suitably fastened to a central shaft 12. Full circumference angled grooves 13 are formed in the shell. Full circumference parallel channels 14 are formed in the base of each groove. In operation, bagasse is tightly compacted into the angled grooves 13 and the outer portion of the parallel channels 14 by the action of the horizontally opposed other roll. Juice is free to move radially in to and down through the parallel juice channels 14 and to exit from the base of the roll.

Figure 3:
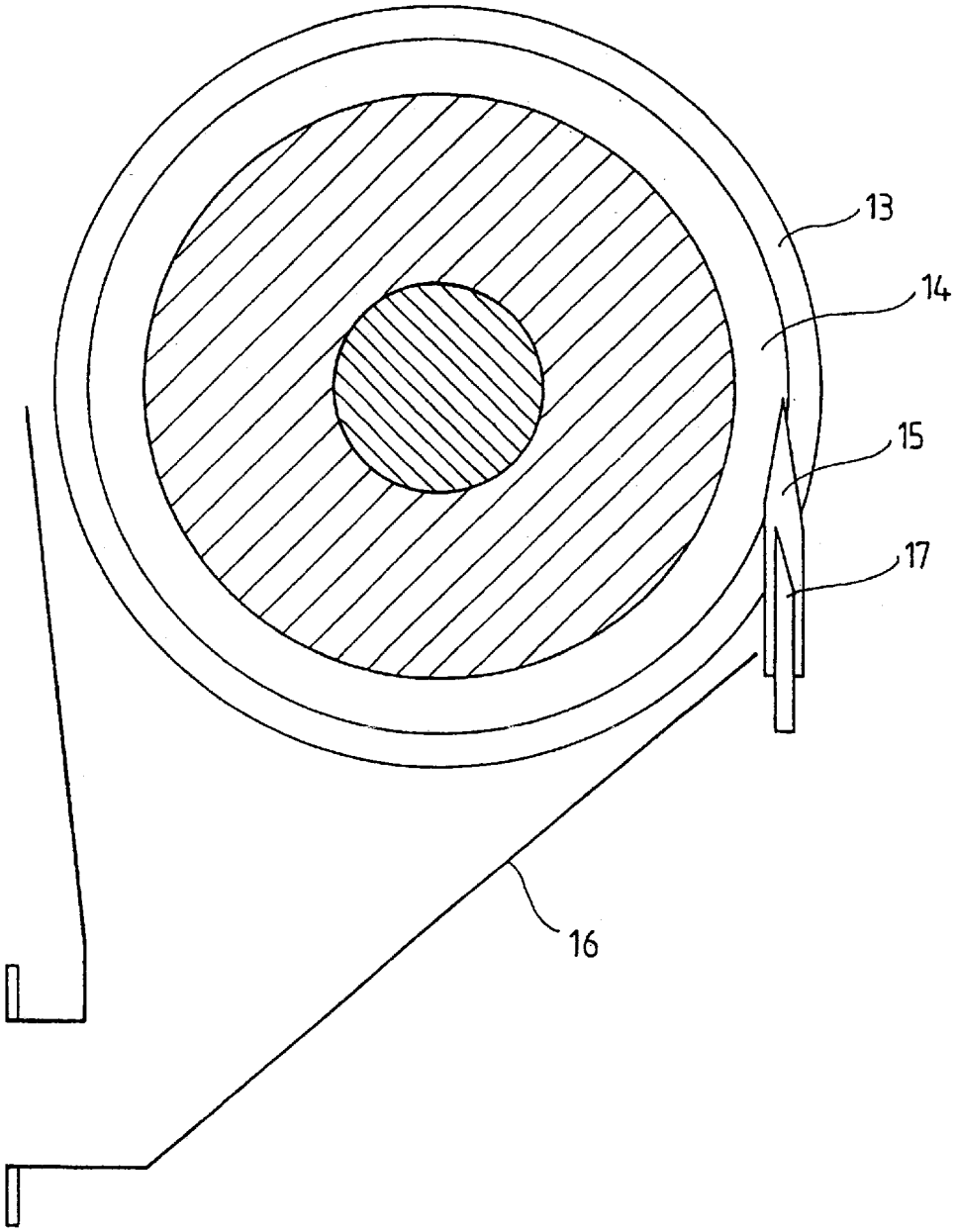
FIG. 3 is an end view of the mill roll of FIG. 2.

FIG. 3 illustrates the axial cross-section of roll 10 through the mid-plane of one of the full circumference angled groove and parallel juice channels. The cross-section of the primary and secondary scrapers and the collecting juice tray is also shown. The scraper moves compacted bagasse from the angled groove 13 and the outer portion of the parallel juice channel 14. Blades 15 are positioned so that the leading tips of the blades penetrate the parallel juice channel 14 deeper than any tightly compacted bagasse. As the roll and bagasse move downwards, the blades 15 push the bagasse to the right, out of the groove and into a discharge chute. Juice is free to drain down the full circumference channel 14 to the base of the roll to discharge into juice collecting trays 16. The blades 15 are slightly thinner than the width of the parallel juice channel 14. The blades 15 are supported by a plate 17 that has an angled top to direct loose bagasse into the bagasse discharge chute.

Figure 4:
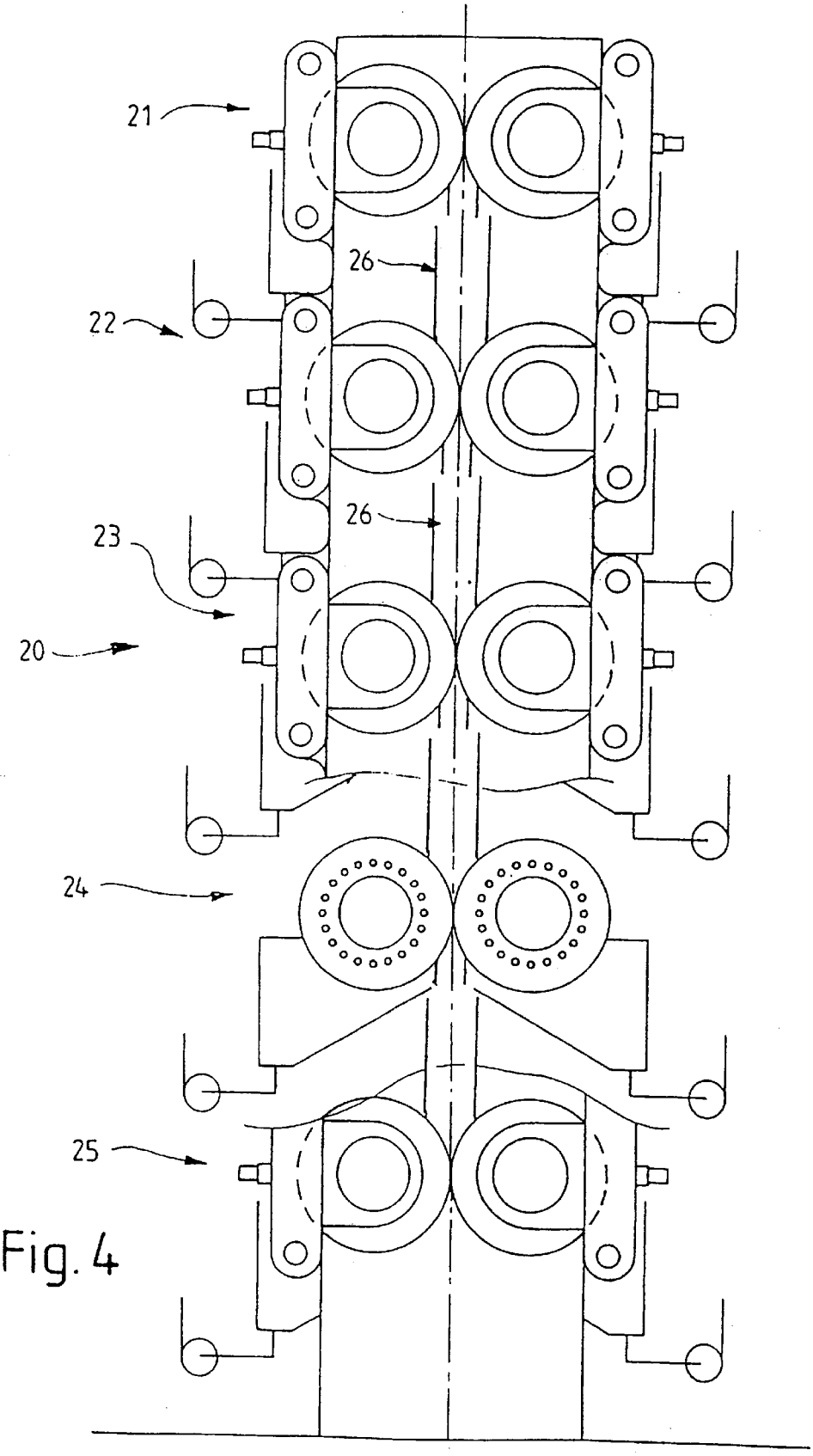
FIG. 4 illustrates a vertical tower mill according to an embodiment of the invention and showing a vertical set of dual opposed rolls interconnected with adjustable enclosed chutes.

Referring to FIG. 4, there is illustrated a vertical tower mill 20. Tower mill 20 consists of five pairs of opposed counter rotating rolls 21–25. Each roll pair 21–25 consists of two counter rotating rolls between which a cane blanket 26 passes and is crushed. Sugar cane billets, crushed cane, or shredded cane is fed into the upper set of rollers 21 by a conventional feed hopper. The juice from the rollers is recycled to the preceding chute by injection pumping. The rollers themselves may be of varying types but preferably are the drainage rolls of FIGS. 2 and 3. In the embodiment, each pair of opposed rolls is driven by a separate drive arrangement. The cane blanket passes vertically through each set of rolls which provides various advantages over a horizontally travelling cane blanket.

Figure 5:
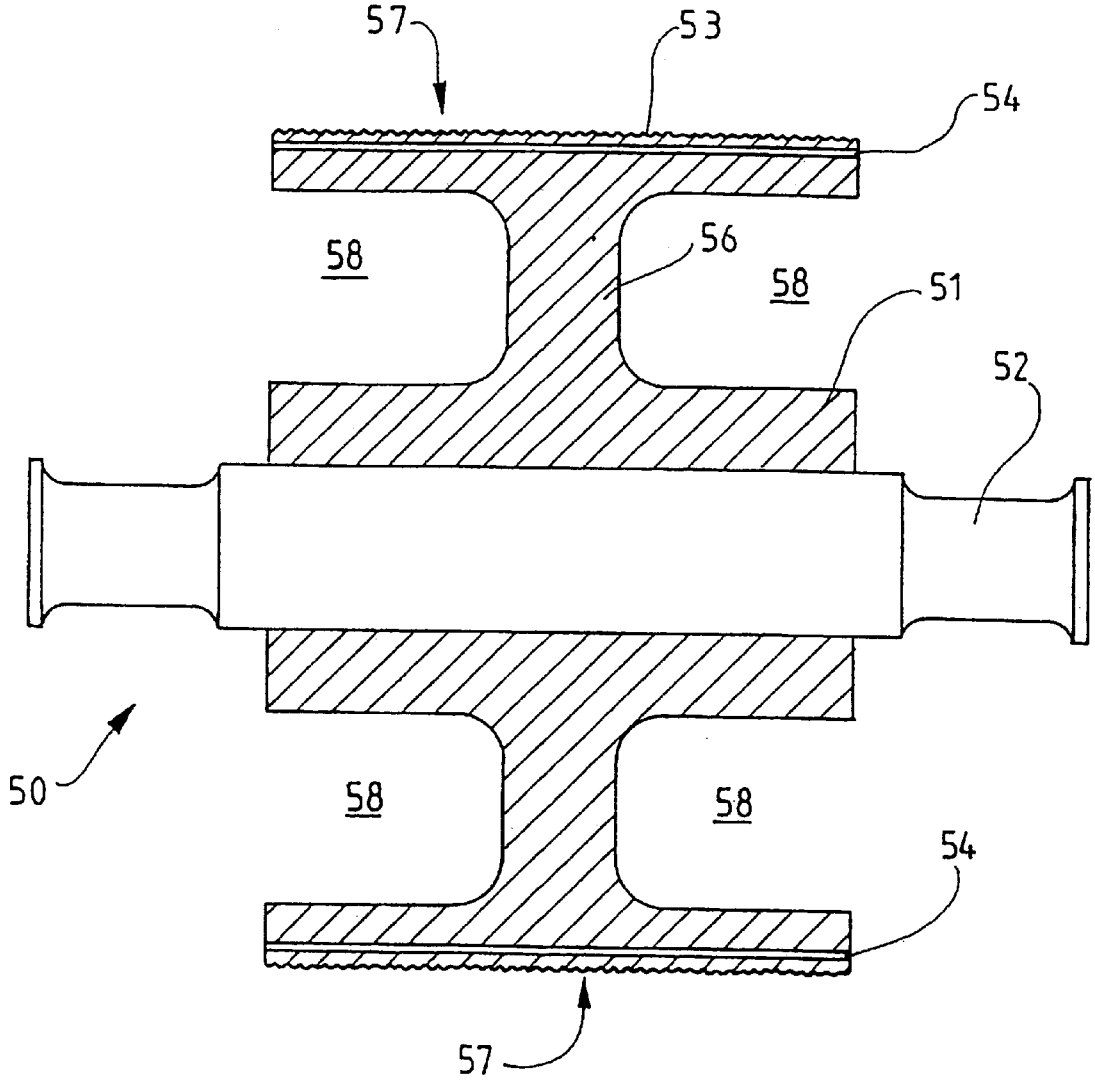
FIG. 5 shows a section view of a mill roll according to an embodiment attached to a shaft.

Referring to FIG. 5, there is shown a sugar cane mill roll 50 made from cast iron and which is mounted to a rotatable shaft 52. The roll is mounted for non-rotational movement relative to shaft 52.

The roll has a hub portion 51, an outwardly extending web portion 56 which has a thickness considerably less than hub portion 51, and a rim portion 57. Rim portion 57 is formed with grooves 53 of the type which are known in the art. Rim portion is formed with perforations and/or slots which communicate with a longitudinal juice channels 54 to carry away extracted sugar juices.

It can be seen that the roll has two large weight-reducing annular voids 58 which exist because of the relative thin walled construction of web portion 56. These voids considerably reduce the weight of the roll which in turn allows the roll to be considerably longer than hitherto possible, or allows the roll to have a much larger diameter than hitherto possible.

This in turn results in a more efficient crushing capacity and juice extraction.

It should be appreciated that various other changes and modifications may be made to the embodiments described without departing from the spirit and scope of the invention.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

We claim:

1. An apparatus for extracting juice from sugar cane, the apparatus having a pair of counter rotating rolls with a crushing zone between the rolls in which the cane is crushed, at least one of the rolls having a peripheral juice channel extending about the roll and into which sugar juice can flow, the channel being configured such that, in use, a sealing plug of bagasse forms in an upper portion of the channel with a lower portion of the channel left free for holding the juice, bagasse plug removing means to remove the plug of bagasse after the bagasse has moved through the crushing zone to allow the juice to drain from the channel at a position where the juice does not contact the crushed cane blanket.

2. The apparatus of claim 1, wherein the rolls are arranged such that the cane passes between the rolls in a substantially vertical direction which results in juice draining from both rolls.

3. The apparatus of claim 2, wherein both rolls have said peripheral juice channel and said bagasse plug removing means.

4. The apparatus of claim 1, wherein the juice channel is substantially U-shaped with parallel side walls, the channel having a depth larger than the grooves in a conventional roll.

5. The apparatus of claim 1, wherein the juice channels have a narrower necked portion which opens into a larger channel portion.

6. A mill containing a plurality of pairs of spaced apart counter rotating rolls between which the sugar cane passes and is crushed, the rollers being arranged such that the cane passes between the rollers in a substantially vertical direction, at least some of the pairs of rolls having a peripheral juice channel extending about the roll and into which sugar juice can flow, the channel being configured such that a sealing plug of bagasse can form in an upper portion of the channel with a lower portion of the channel left free for holding the juice, bagasse plug removing means to remove the plug of bagasse to allow the juice to drain from the channel at a position where the juice does not contact the crushed cane blanket.

7. A method for extracting juice from sugar cane comprising crushing the cane between a pair of spaced apart counter rotating rolls, passing extracted juice into a juice channel on at least one of the rollers, sealing the channel opening with a layer of compacted bagasse in the crushing zone of the rollers, rotating the roller to move the sealed channel away from the crushing zone and into a juice collecting zone and removing the bagasse compacted in the channel after crushing to allow the channel to be drained.

8. The method of claim 7 where the cane moves in a generally vertical direction.

* * * * *